US011462853B2

(12) United States Patent
Yuan et al.

(10) Patent No.: US 11,462,853 B2
(45) Date of Patent: Oct. 4, 2022

(54) CABLE CONNECTOR EQUIPPED WITH DIFFERENT REAR CASES FOR DIFFERENT DIRECTIONAL CABLE EXTENSION

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Shun-Ying Yuan, Kunshan (CN); Bin Peng, Kunshan (CN); Jian-Kuang Zhu, Kunshan (CN); Kuo-Chun Hsu, New Taipei (TW)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 17/190,353

(22) Filed: Mar. 2, 2021

(65) Prior Publication Data

US 2021/0273368 A1 Sep. 2, 2021

(30) Foreign Application Priority Data

Mar. 2, 2020 (CN) ..... 202020240287.6

(51) Int. Cl.

| | |
|---|---|
| ***H01R 13/502*** | (2006.01) |
| ***H01R 43/20*** | (2006.01) |
| ***H01R 43/18*** | (2006.01) |
| *H01R 13/52* | (2006.01) |

(52) U.S. Cl.

CPC ..... *H01R 13/502* (2013.01); *H01R 43/18* (2013.01); *H01R 43/20* (2013.01); *H01R 13/5202* (2013.01)

(58) Field of Classification Search

CPC ..... H01R 13/502; H01R 13/5202; H01R 13/5841; H01R 43/18; H01R 43/20

See application file for complete search history.

(56) References Cited

U.S. PATENT DOCUMENTS

| | | | | |
|---|---|---|---|---|
| 5,911,595 A * | 6/1999 | Orr, Jr. | H01R 13/567 439/471 |
| 6,945,814 B2 * | 9/2005 | Snape | H01R 35/02 439/165 |
| 9,997,858 B2 * | 6/2018 | Mogi | H01R 9/223 |
| 10,424,866 B1 * | 9/2019 | Peng | H01R 24/50 |

(Continued)

*Primary Examiner* — Abdullah A Riyami
*Assistant Examiner* — Nader J Alhawamdeh
(74) *Attorney, Agent, or Firm* — Ming Chieh Chang

(57) ABSTRACT

An electrical connector includes an insulative front housing, an insulative rear housing and a plurality of contacts. The front housing forms a mating cavity. The contact includes a contacting section extending into the mating cavity, a retaining section retained to the front housing, and a connecting section connected with the wire. The rear housing includes a front receiving space and a rear receiving space communicating with each other. The rear portion of the front housing is assembled into the front receiving space of the rear housing to have the connecting sections of the contacts exposed in the front receiving space. The rear receiving space receives the corresponding wires therein with corresponding opening to allow the wires to extend therethrough.

20 Claims, 13 Drawing Sheets

(56) References Cited

U.S. PATENT DOCUMENTS

| | | | | |
|---|---|---|---|---|
| 10,714,854 | B2 * | 7/2020 | Peng | H01R 13/641 |
| 2019/0237889 | A1 * | 8/2019 | Peng | H01R 13/641 |
| 2020/0243998 | A1 | 7/2020 | Deng et al. | |
| 2020/0381854 | A1 | 12/2020 | Zou et al. | |
| 2021/0273368 | A1 * | 9/2021 | Yuan | H01R 13/502 |

* cited by examiner

CABLE CONNECTOR EQUIPPED WITH DIFFERENT REAR CASES FOR DIFFERENT DIRECTIONAL CABLE EXTENSION

BACKGROUND OF THE INVENTION

1. Field of the Invention

The present invention relates to an electrical cable connector, and particularly to the electrical cable connector equipped with different rear cases for different cable extension.

2. Description of Related Arts

US Patent Application Publication No. 2020/0243998 discloses an electrical connector includes two types cable extension, i.e., the rearward type and the downward type wherein each type requires a front main housing to cooperate with a rear cover for reliably retaining the corresponding cables with regard to the connector. Each type connector requires its own main housing and rear cover in configuration, thus essentially being uneconomic.

Therefore, it is desired to provide an electrical connector with different directional cable extension while allowing sharing the same front main housing economically.

SUMMARY OF THE INVENTION

An electrical connector includes an insulative front housing, an insulative rear housing and a plurality of contacts. The front housing forms a mating cavity. The contact includes a contacting section extending into the mating cavity, a retaining section retained to the front housing, and a connecting section connected with the wire. The rear housing includes a front receiving space and a rear receiving space communicating with each other. The rear portion of the front housing is assembled into the front receiving space of the rear housing to have the connecting sections of the contacts exposed in the front receiving space. The rear receiving space receives the corresponding wires therein with corresponding opening to allow the wires to extend therethrough.

Other advantages and novel features of the invention will become more apparent from the following detailed description of the present embodiment when taken in conjunction with the accompanying drawings.

DETAILED DESCRIPTION OF THE PREFERRED EMBODIMENT

Figure 1:
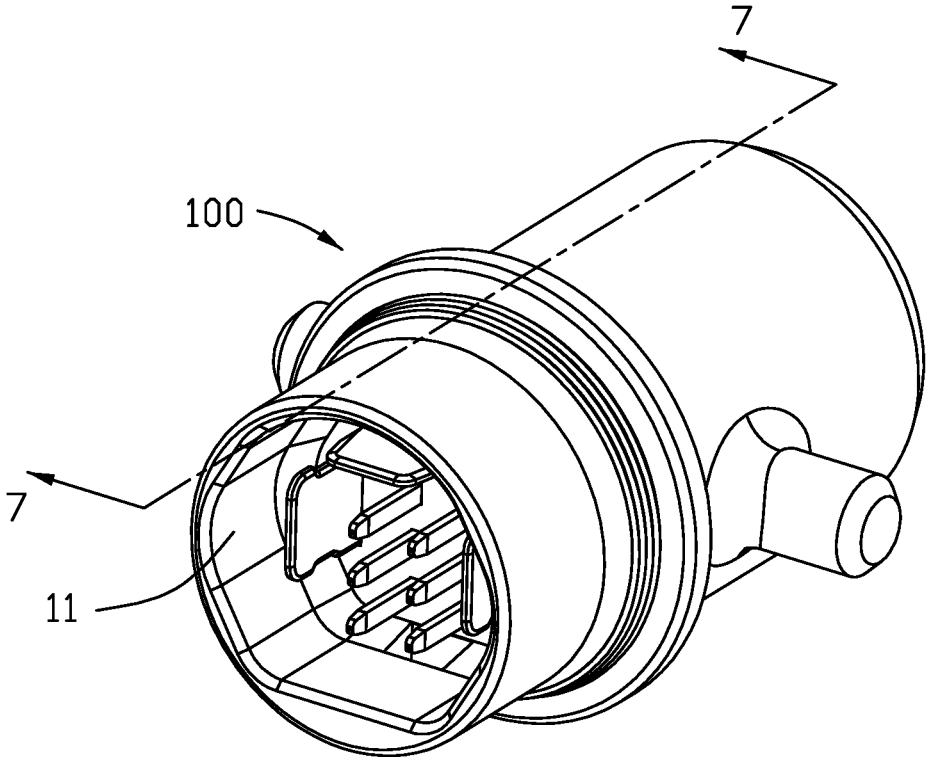
FIG. 1 is a perspective view of an electrical connector according to a first embodiment of the invention.
Figure 2:
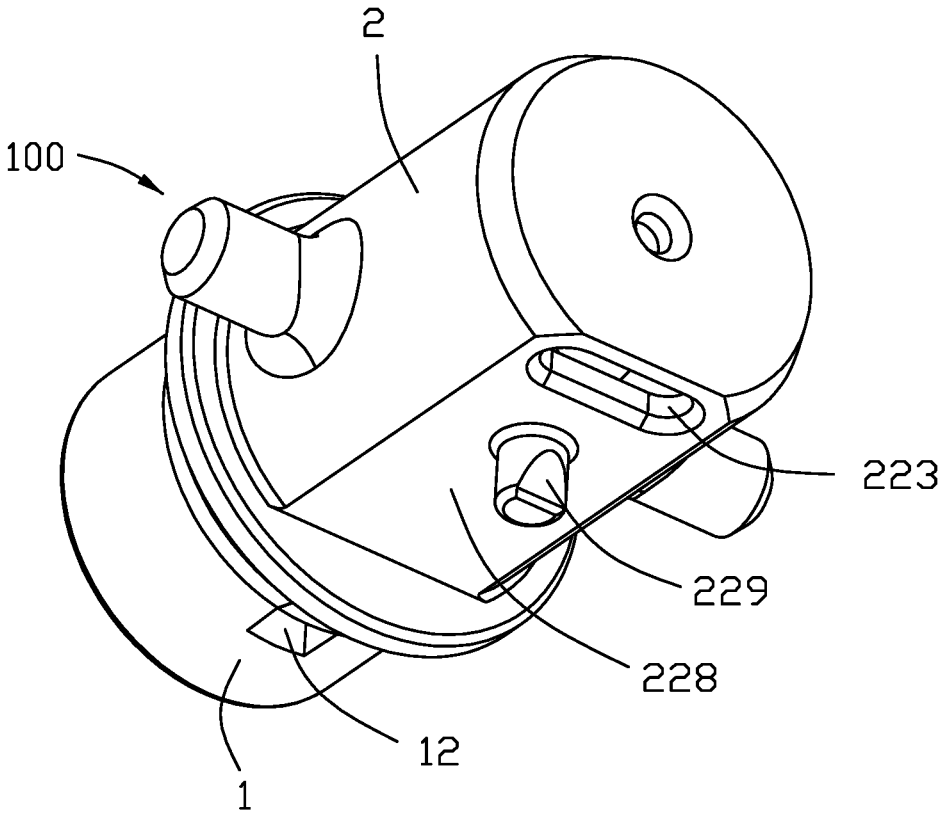
FIG. 2 is another perspective view of the electrical connector of FIG. 1.
Figure 3:
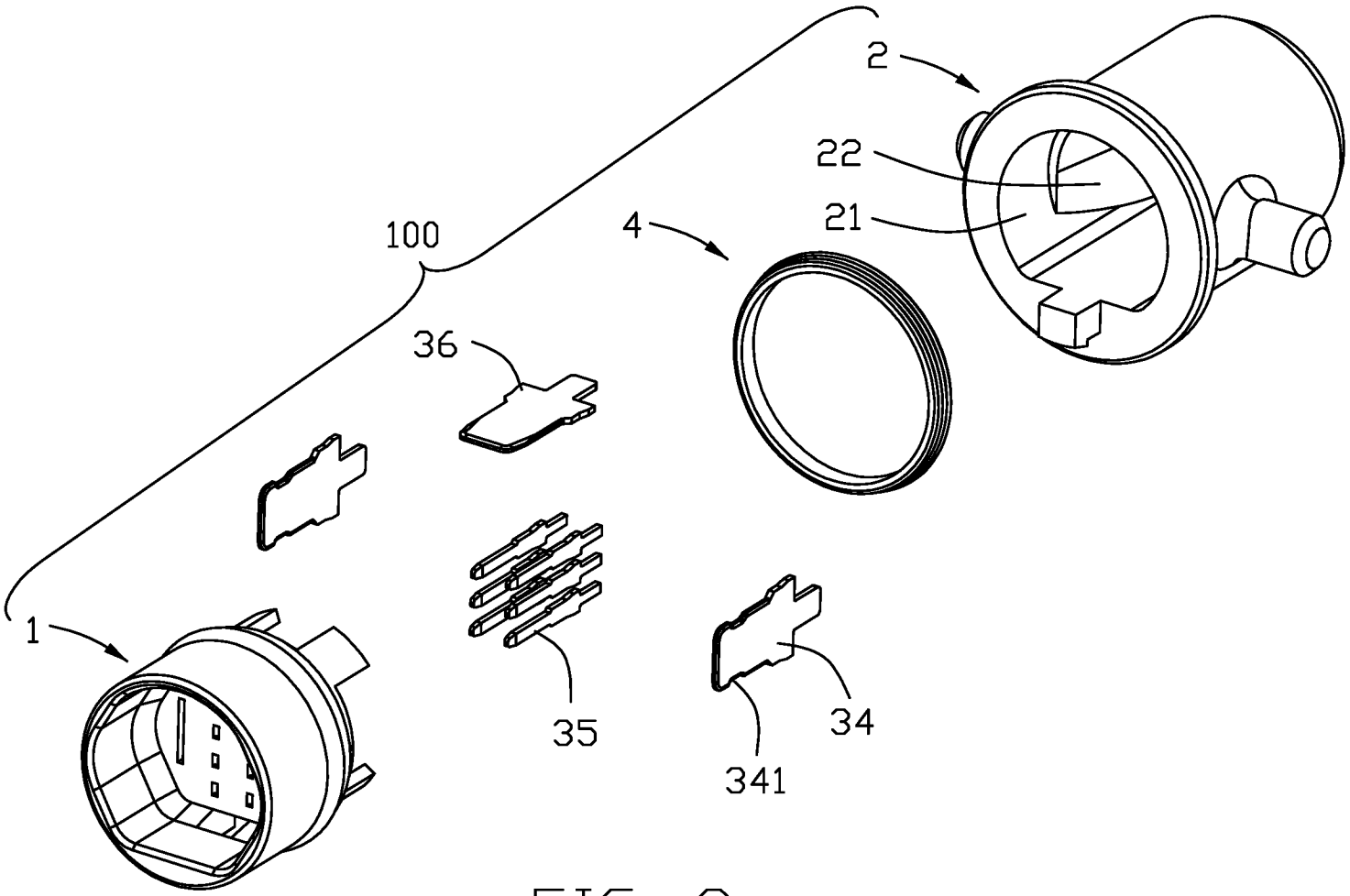
FIG. 3 is an exploded perspective view of the electrical connector of FIG. 1.
Figure 4:
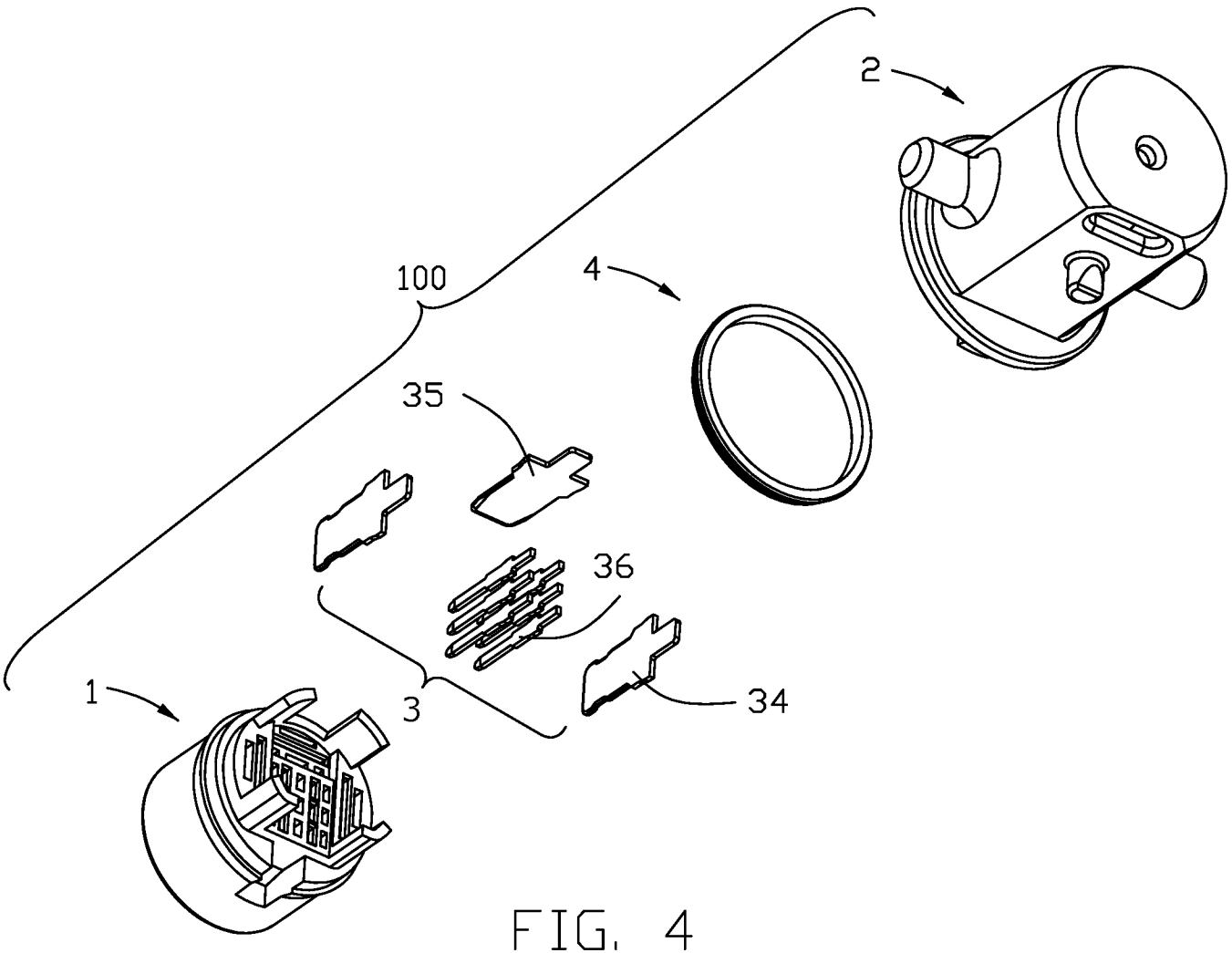
FIG. 4 is another exploded perspective view of the electrical connector of FIG. 3.
Figure 5:
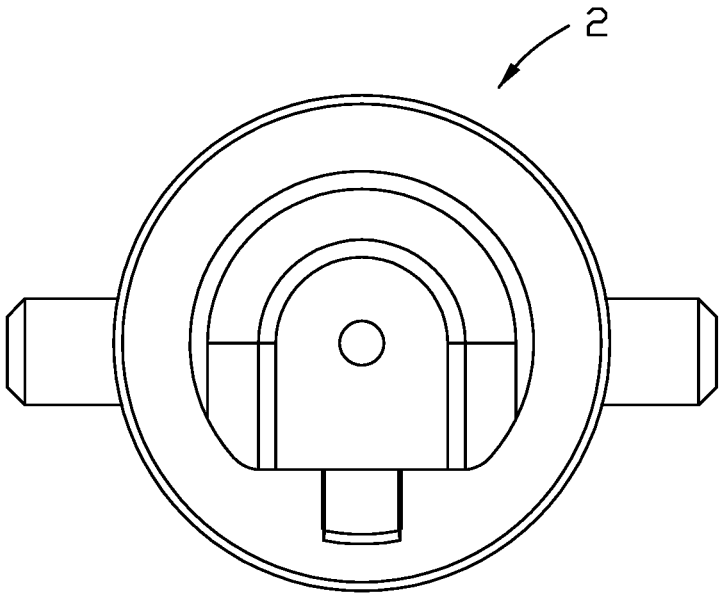
FIG. 5 is an elevational view of the rear housing of the electrical connector of FIG. 1.
Figure 6:
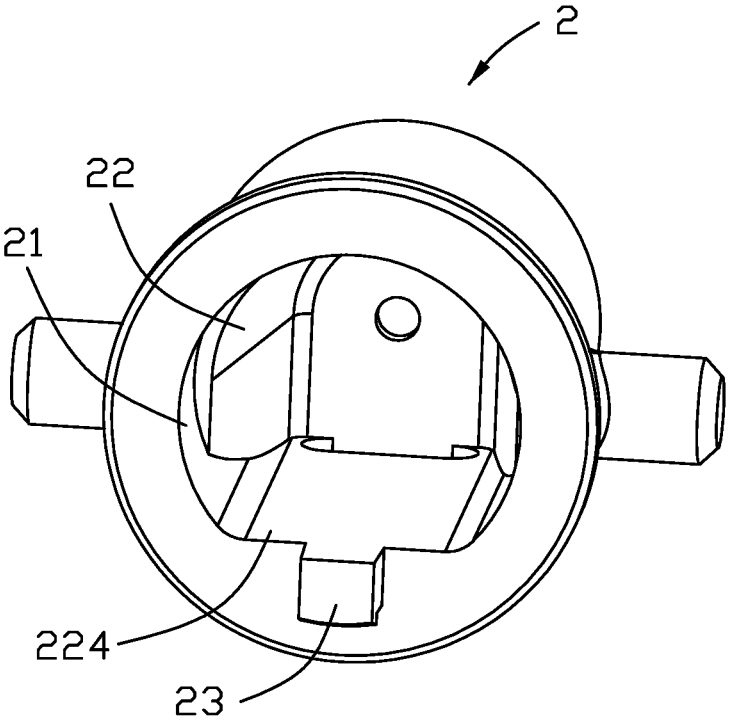
FIG. 6 is a perspective view of the rear housing of the electrical connector of FIG. 1.

Referring to FIGS. 1-7, an electrical connector 100 includes an insulative front housing 1, an insulative rear housing 2, and a plurality of contacts 3. The front housing 1 includes a mating cavity 11 forwardly communicating with an exterior through a front face of the front housing. The contacts 3 includes a front contacting section 31 extending into the mating cavity 11, a middle retaining section 32 retaining in the front housing 1, and a rear connecting section 33 for connecting to the wire W. Notably, the respective wires may optimally commonly form a cable C. The rear housing 2 includes a front receiving space 21 and a rear receiving space 22. The rear portion of the front housing 1 is assembled into the front receiving space 21 with the connecting sections 33 exposed in the front receiving space 21. The rear receiving space 22 includes a cylindrical wall 221 forming an cable exit 223 in a vertical direction, and a rear wall 222 forming a ventilation hole H along the front-to-back direction.

The cylindrical wall 221 forms a planar bottom face 228 with a mounting post 229 downwardly extending therefrom for mounting to a platform or frame. The cable exit 223 is formed in the bottom face 228. The contacts 2 include the power contacts 34, the signal contacts 35 and the grounding contacts 36. The power contact 34 forms a pair of notches 341. There are six signal contacts 35. A pair of power contacts 34 are located by two side of the signal contacts 35 in the horizontal direction. One grounding contact 36 is located above the signal contacts 35 in the vertical direction.

Figure 7:
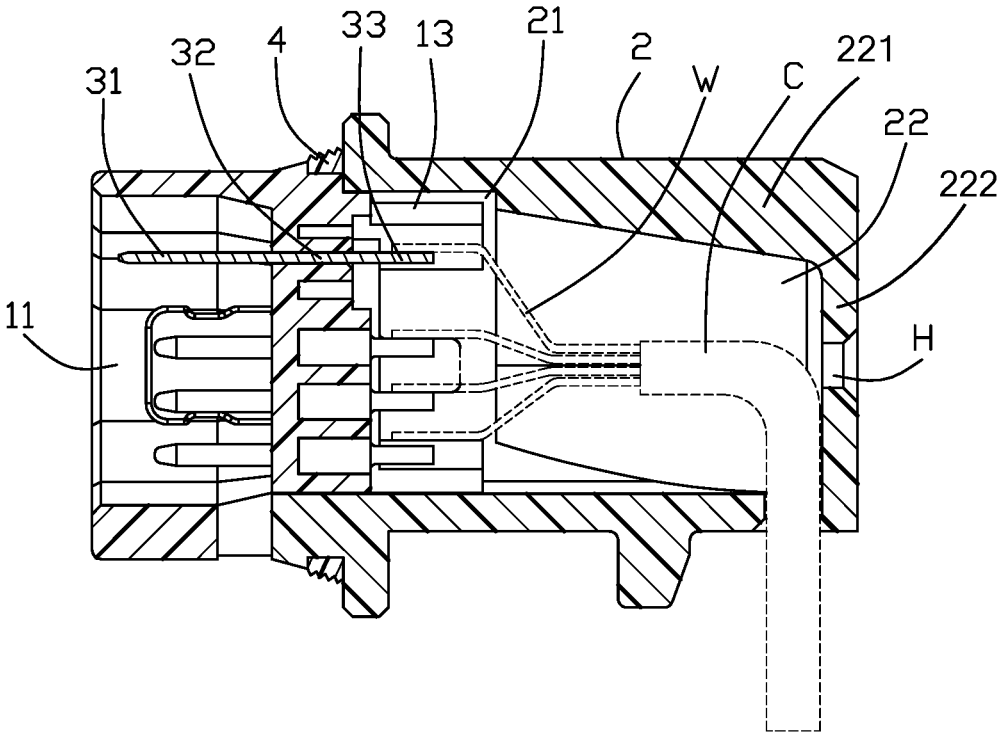
FIG. 7 is a cross-sectional side view of the electrical connector of FIG. 1.
Figure 8:
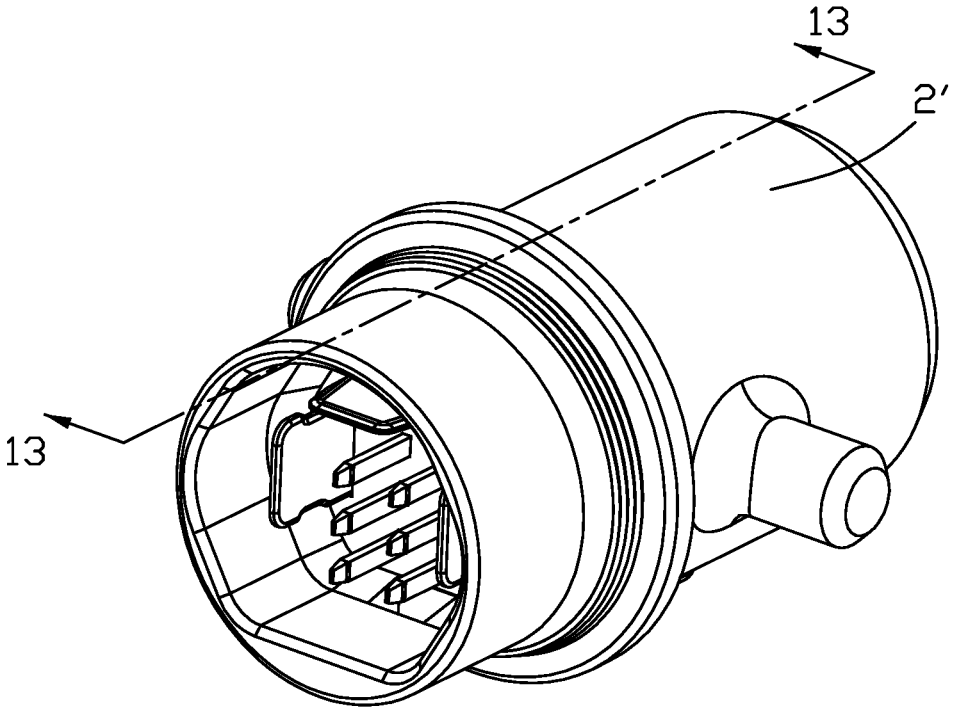
FIG. 8 is a perspective view of the electrical connector according to a second embodiment of the invention.
Figure 9:
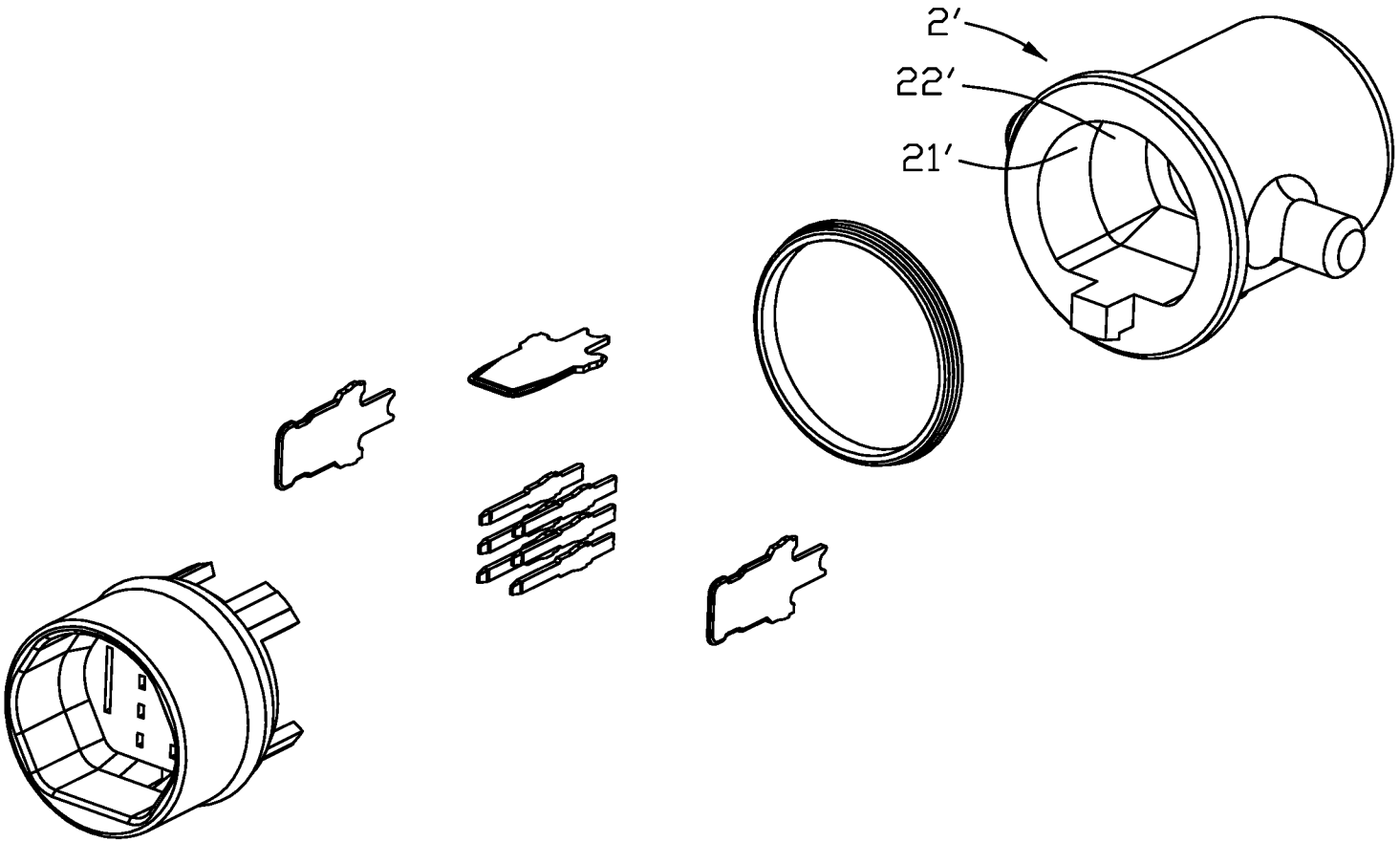
FIG. 9 is an exploded perspective view of the electrical connector of FIG. 8.
Figure 10:
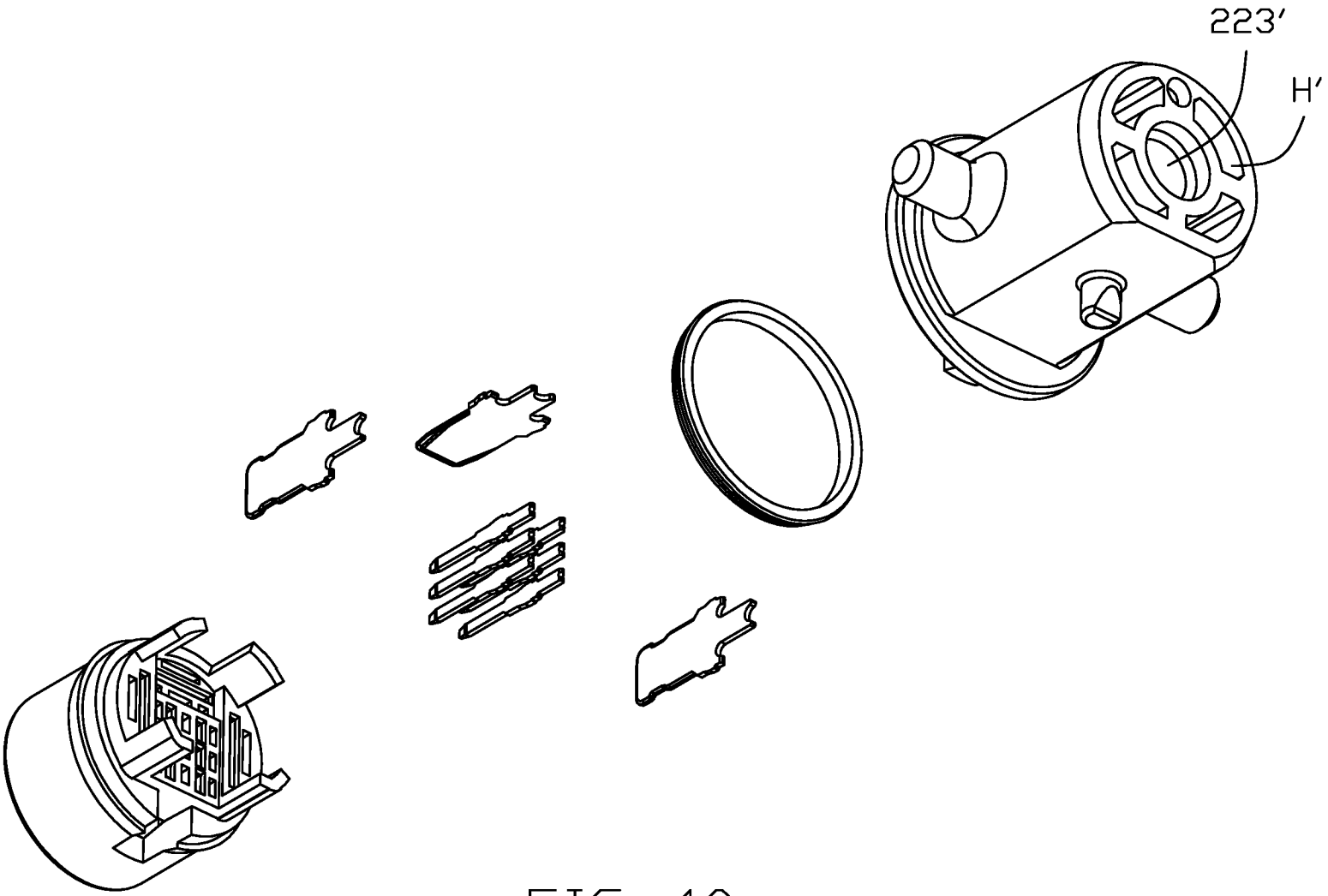
FIG. 10 is another exploded perspective view of the electrical connector of FIG. 9.
Figure 11:
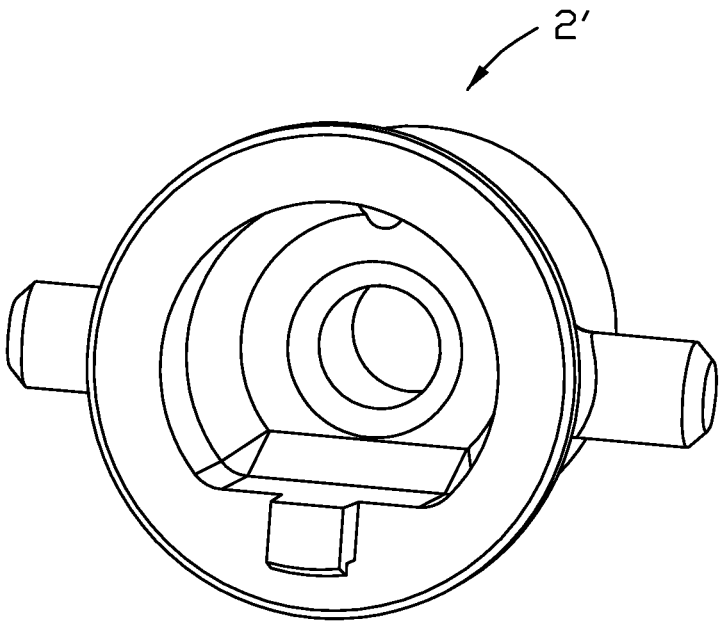
FIG. 11 is a perspective view of the rear housing of the electrical connector of FIG. 8.
Figure 12:
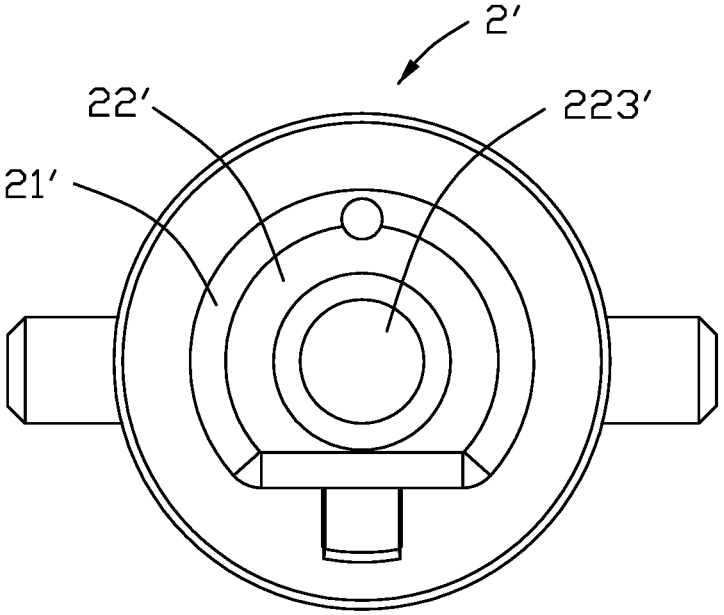
FIG. 12 is an elevational view of the rear housing of the electrical connector of FIG. 11.
Figure 13:
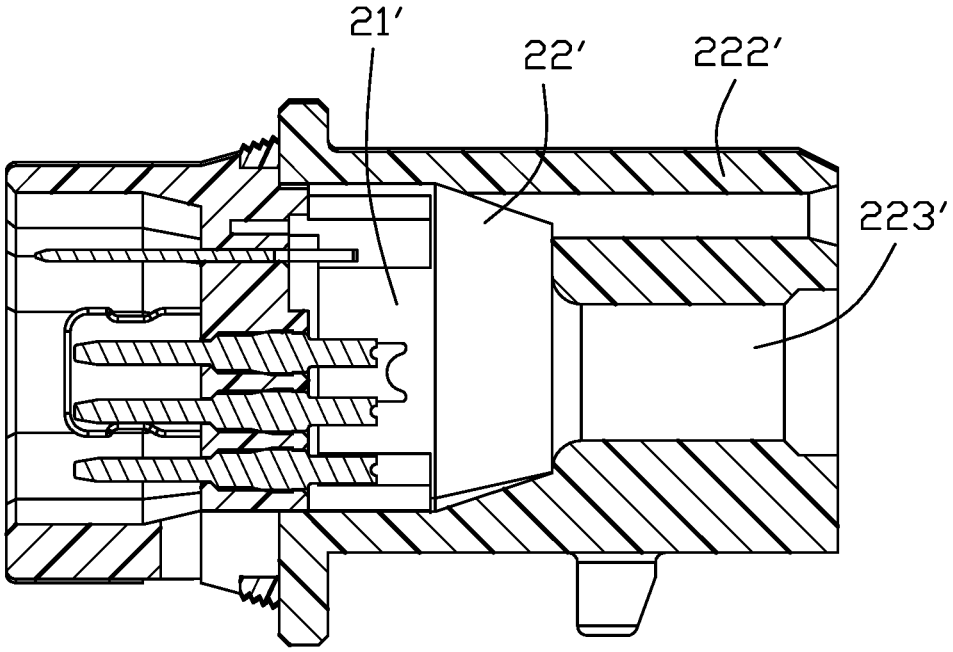
FIG. 13 is a cross-sectional view of the electrical connector of FIG. 8.

An interior surface 224 is formed in the cylindrical wall 221 opposite to the bottom face 228. Thus, the cable exit 223 extends through both the bottom face 228 and the interior surface 224 for allowing the corresponding wires (not shown) to extend therethrough. An alignment protrusion 23 is formed on a front face of the rear housing 2 to be received within the corresponding recess 12 in the front housing 1 so as to have the front housing 1 and the rear housing 2 assembled and aligned together. The front housing 1 includes a restriction section 13 extending into the front receiving space 21 for engagement with the cylindrical wall 221 of the rear housing 2. The front housing 1 and the rear housing 2 are assemble together via glue, and a rubber ring 4 is sandwiched between the front housing 1 and the rear housing 2 in the front-to-back direction. Notably, as shown in FIG. 7, a bottom portion of the rubber ring 4 is retained in the protrusion 23. As shown in FIG. 7, an interior face of an upper portion of the cylindrical wall 221 is downwardly tapered toward the rear wall 222 to thicken the cylindrical wall 221 for structure consideration.

Referring to FIGS. 8-13 disclosing the second embodiment, an electrical connector is essentially similar to that in the first embodiment except the rear housing 2' is somewhat different from the rear housing 2 in the first embodiment. The rear housing 2' includes a front receiving space 21' and a rear receiving space 22' wherein the rear receiving space 22' is converged toward the rear wall 222'. The rear wall 222' is relatively thicker than the rear wall 222 in the first embodiment, and the cable exit 223' extends through the rear wall 222' in the front-to-back direction. Similar to the first embodiment, the rear wall 222' forms the ventilation holes H' therein to surround the cable exit 223'.

In conclusion, both embodiments share the same front housing 1 while the rear housing 2 in the first embodiment guides the corresponding cables to extend in the vertical direction through the downward cable exit 223 and the rear housing 2' in the second embodiment guides the corresponding cables to extend in the horizontal direction through the rearward cable exit 223'. Therefore, compared with the prior arts, the instant invention economically makes the corresponding connector advantageously.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector comprising:

an insulative front housing defining a cylindrical configuration with a mating cavity therein;

an insulative rear housing assembled to a rear side of the front housing along a front-to-back direction, formed by a cylindrical wall and a rear wall, and defining, along the front-to-back direction, a front receiving space and a rear receiving space for receiving a plurality of wires;

a plurality of contacts retained within the front housing, each contact including a front contact section extending into the mating cavity, a middle retaining section retained to the front housing, and a rear connecting section rearwardly extending into the front receiving space for connecting to one corresponding wire; wherein the rear housing is categorized with two types adapted to be mutually exclusively assembled to the front housing selectively, of which a first type defines a cable exit in the cylindrical wall for allowing cable extension in a vertical direction perpendicular to the front-to-back direction, and a second type defines the cable exit in the rear wall for allowing cable extension in the front-to-back direction.

2. The electrical connector as claimed in claim 1, wherein the cylindrical wall includes a plane bottom face with a downwardly extending mounting post thereon.

3. The electrical connector as claimed in claim 2, wherein in the first type rear housing, the cable exit extends through the bottom face in the vertical direction.

4. The electrical connector as claimed in claim 3, wherein at least a ventilation hole extends through the rear wall in the front-to-back direction.

5. The electrical connector as claimed in claim 4, wherein in the second type rear housing, said cable exit is essentially located at a center of the rear wall, and more than one ventilation holes surround the cable exit circumferentially.

6. The electrical connector as claimed in claim 3, wherein in the first type rear housing, the cable exit is located intimately adjacent to the rear wall.

7. The electrical connector as claimed in claim 1, wherein a front portion of the rear housing forms an alignment protrusion and a rear portion of the front housing forms a recess to receive the alignment protrusion for correctly aligning the front housing and the rear housing together.

8. The electrical connector as claimed in claim 7, wherein the cylindrical wall includes a plane bottom face with a downwardly extending mounting post thereon, and the alignment protrusion is essentially in alignment with the bottom face and the associated mounting post in the front-to-back direction.

9. The electrical connector as claimed in claim 7, wherein a rubber ring is sandwiched between the front housing and the rear housing.

10. The electrical connector as claimed in claim 9, wherein a portion of the rubber ring is retained in the alignment protrusion.

11. The electrical connector as claimed in claim 1, wherein the rear wall of the second type rear housing is thicker than that of the first type rear housing.

12. An electrical connector comprising:

an insulative front housing defining a cylindrical configuration with a mating cavity therein;

an insulative rear housing assembled to a rear side of the front housing along a front-to-back direction, formed by a cylindrical wall and a rear wall, and defining, along the front-to-back direction, a front receiving space and a rear receiving space for receiving a plurality of wires; and a plurality of contacts retained within the front housing, each contact including a front contact section extending into the mating cavity, a middle retaining section retained to the front housing, and a rear connecting section rearwardly extending into the front receiving space for connecting to one corresponding wire; wherein the cylindrical wall includes a plane bottom face with a downwardly extending mounting post thereon.

13. The electrical connector as claimed in claim 12, wherein a cable exit extends through the bottom face in the vertical direction.

14. The electrical connector as claimed in claim 13, wherein the cable exit is located intimately adjacent to the rear wall.

15. The electrical connector as claimed in claim 13, wherein the rear housing forms an alignment protrusion to be received within a recess formed in the front housing, and the alignment protrusion is in alignment with the mounting post in the front-to-back direction.

16. The electrical connector as claimed in claim 15, wherein a rubber ring is sandwiched between the front housing and the rear housing, and a portion of the rubber ring is retained in the alignment protrusion.

17. A method of making an electrical connector comprising steps of:

providing an insulative front housing with a mating cavity;

assembling a plurality of contacts into the front housing wherein each contact includes a front contacting section extending into the mating cavity, a middle retaining section retained to the front housing, and a rear connecting section;

providing an insulative rear housing with a cylindrical wall and a rear wall to commonly form a front receiving space and a rear receiving space for receiving corresponding wires;

assembling the rear housing to the front housing with the rear connecting sections of the contacts extending into the front receiving space for connecting to the corresponding wires, respectively; wherein the rear housing is categorized with two types adapted to be mutually exclusively assembled to the front housing selectively, of which a first type defines a cable exit in the cylindrical wall for allowing cable extension in a vertical direction perpendicular to the front-to-back direction, and a second type defines the cable exit in the rear wall for allowing cable extension in the front-to-back direction.

18. The method as claimed in claim 17, wherein the cylindrical wall includes a plane bottom face with a downwardly extending mounting post thereon.

19. The method as claimed in claim 18, wherein in the first type rear housing, the cable exit extends through the bottom face in the vertical direction.

20. The method as claimed in claim 17, wherein a front portion of the rear housing forms an alignment protrusion and a rear portion of the front housing forms a recess to receive the alignment protrusion for correctly aligning the front housing and the rear housing together, and the alignment protrusion is essentially in alignment with the bottom face and the associated mounting post in the front-to-back direction.

* * * * *